US007625304B2

(12) United States Patent
Villanueva

(10) Patent No.: US 7,625,304 B2
(45) Date of Patent: Dec. 1, 2009

(54) STRAIGHT SHOT

(76) Inventor: Armando Villanueva, 4980 N. Marine Dr. #832, Chicago, IL (US) 60640

( * ) Notice: Subject to any disclaimer, the term of this patent is extended or adjusted under 35 U.S.C. 154(b) by 6 days.

(21) Appl. No.: 11/726,617

(22) Filed: Mar. 21, 2007

(65) Prior Publication Data

US 2008/0020869 A1 Jan. 24, 2008

Related U.S. Application Data

(60) Provisional application No. 60/785,430, filed on Mar. 24, 2006.

(51) Int. Cl.
*A63A 69/00* (2006.01)
*G09B 19/00* (2006.01)

(52) U.S. Cl. ..... 473/447; 473/422; 434/248

(58) Field of Classification Search ..... 473/422, 473/433, 447, 449, 472, 479–489, 266, 267, 473/462, 446; 434/247, 248, 252; 248/466, 248/469, 474; 359/836, 871, 872, 850
See application file for complete search history.

(56) References Cited

U.S. PATENT DOCUMENTS 1,832,248 A * 11/1931 Schrader ..... 356/397
3,353,282 A * 11/1967 Sneed ..... 434/257
4,015,344 A * 4/1977 Michaels et al. ..... 434/257
4,083,559 A * 4/1978 Owen, Jr. ..... 473/197
4,693,570 A * 9/1987 Kryder ..... 359/855
5,015,084 A * 5/1991 Kryder ..... 359/872
5,270,871 A * 12/1993 Florian ..... 359/870
5,603,617 A * 2/1997 Light ..... 434/252
5,984,684 A * 11/1999 Brostedt et al. ..... 434/252
6,962,421 B2 * 11/2005 Yang ..... 359/846
7,153,217 B1 * 12/2006 Florian ..... 473/267
2006/0094523 A1 * 5/2006 Hall ..... 473/266
2007/0219024 A1 * 9/2007 Allegre ..... 473/422

* cited by examiner

*Primary Examiner*—Mitra Aryanpour

(57) ABSTRACT

A method is provided for improving a basketball players's shooting skills. A basketball player's shooting skills are improved by aligning a shooting arm with a mirror containing a guiding chaser light. A players's arm follows the vertical movement of the light to the rim in a straight motion, as the basketball is released. This action correctly positions the players' arm in reference to the chaser light bulb. Once a shooting throw is taken, using the product, it will enable the player to achieve the correct arc and trajectory release. The mirror containing the guiding chaser light is placed between the shooter and the basketball rim at any distance allowing the shooter to have visual contact with both the target and the mirror itself, simultaneously, allowing self-correction to take place. The method promotes three vital ingredients to increase correct shooting skills: 1. Muscle memory; 2. Hand and eye coordination; and 3. Allows the shooter to square up correctly.

5 Claims, 6 Drawing Sheets

STRAIGHT SHOT

CROSS REFERENCE TO EARLIER RELATED APPLICATIONS

This application claims priority to Provisional Application No. 60/785,430, with filing date of Mar. 24, 2006.

BRIEF BACKGROUND

This device, after having been tested, has proven to show marked improvements in the basketball players' shooting skills. Existing devices in the Sports Equipment field, are cumbersome and ineffective compared with "Straight Shot."

BRIEF SUMMARY OF THE INVENTION

"Straight Shot," when used as directed, will enable a player to achieve, enhance and increase the shooting skills desired and the field goal percentages by the player. These and various other features of the invention, as well as advantages, which characterize Straight Shot, prove this invention to be worthwhile.

DETAILED DESCRIPTION

Figure 1:
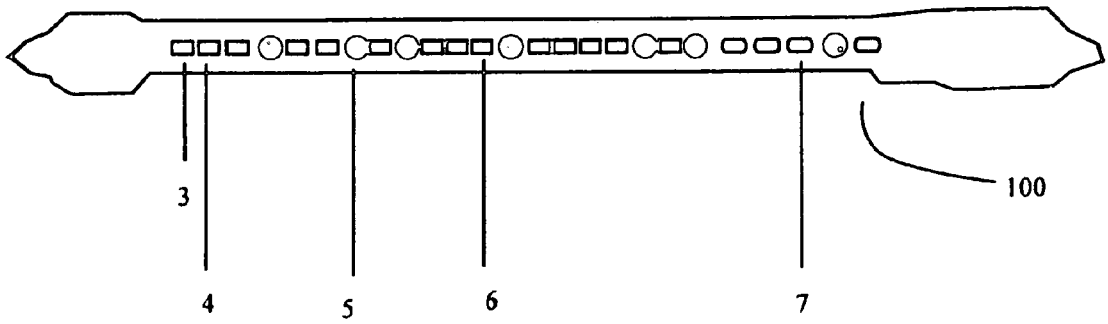
FIG. 1. shows a top view of a chaser bulb.

A top view of the chaser bulb 100 is shown in FIG. 1. The chaser bulb 100 may include ceramic capacitors 3, electronic capacitors 4, LED lights 5, resistors 6 and transistors 7. These components are effective for providing light pulses in both directions of the chaser bulb 100. In one aspect, the chaser bulb 100 may have a length of 18.25 inches.

Figure 2:
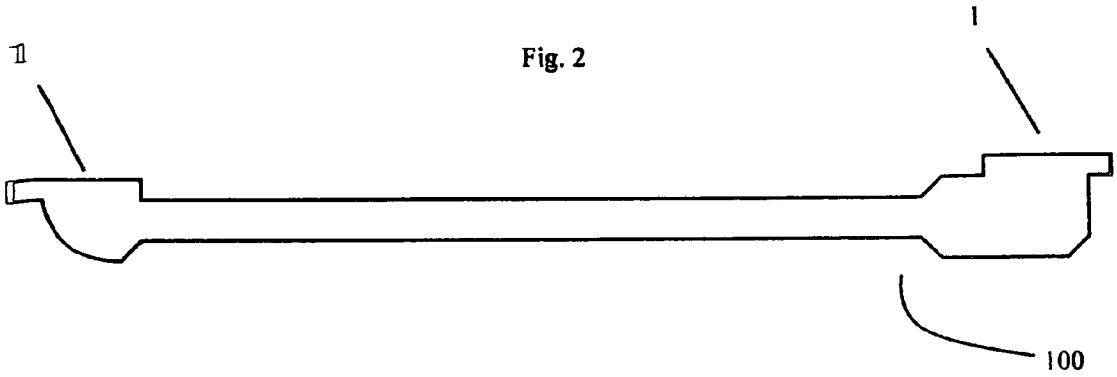
FIG. 2. shows a side view of a chaser bulb.

A side view of the chaser bulb 100 is shown in FIG. 2. The chaser bulb 100 may include adhesive bottom portions 1.

Figure 3:
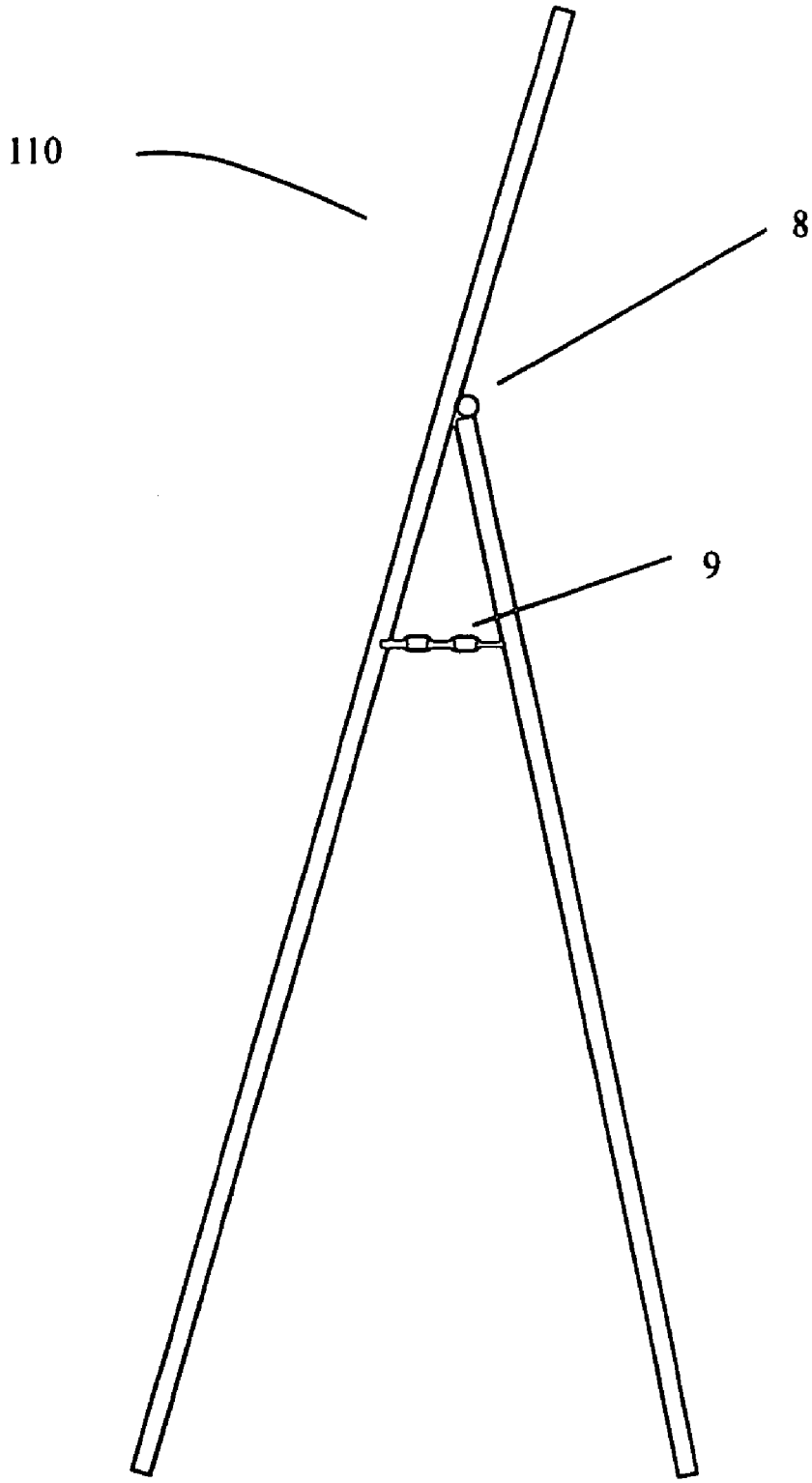
FIG. 3. illustrates an "Ebony Mirror".

FIG. 3 illustrates a side perspective view of the mirror device 110. The mirror device may include hinges 8 and chain attachment 9.

Figure 4A:
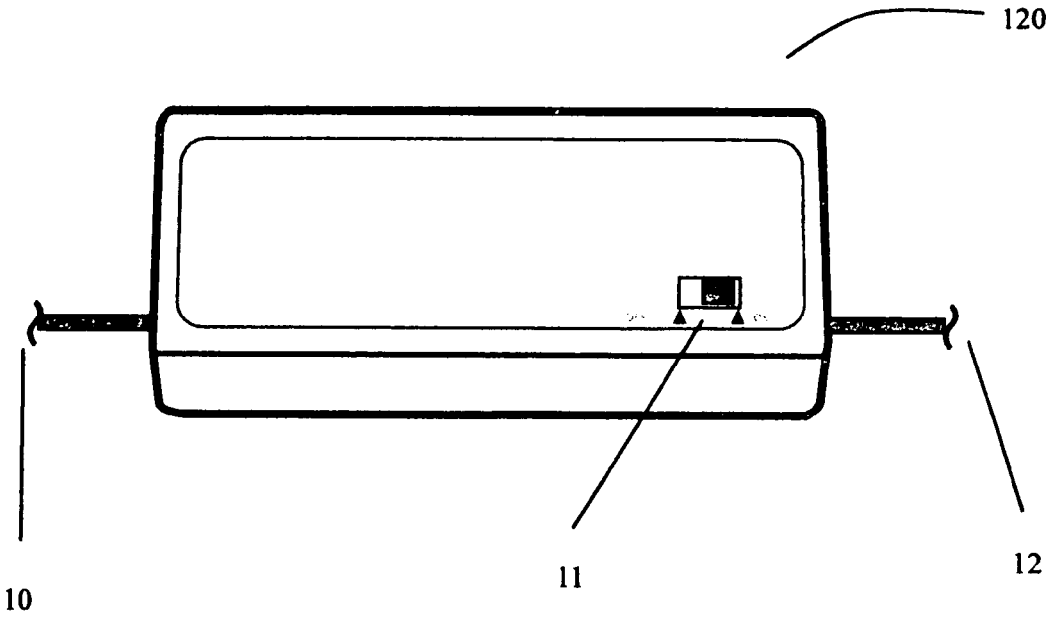
FIG. 4*a* and FIG. 4*b* illustrate a Charger/Adapeter where a front view is shown in FIG. 4*a* and a side view is shown in FIG. 4 *b*.
Figure 4B:
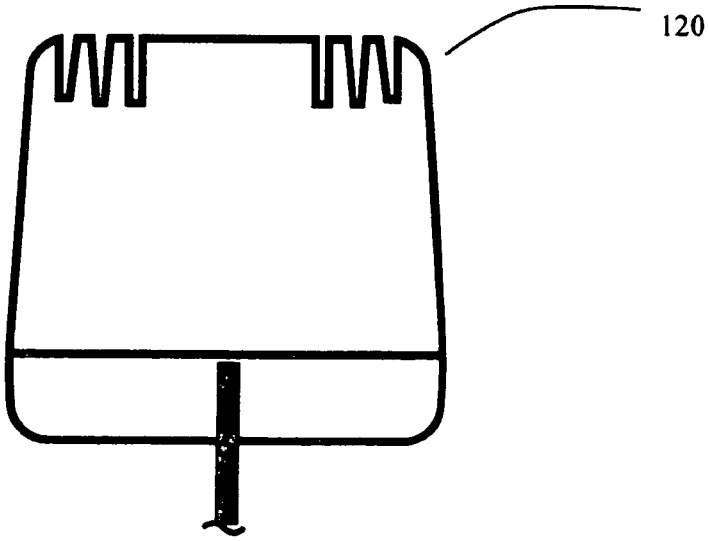

A front view of a charger/adapter component 120 is shown in FIG. 4*a*. The charger/adaptor component includes input cord/wire 10, power conversion switch 11 and cord to wall plug 12. A side view of the charger/adapter component 120 is shown in FIG. 4*b*.

Figure 5:
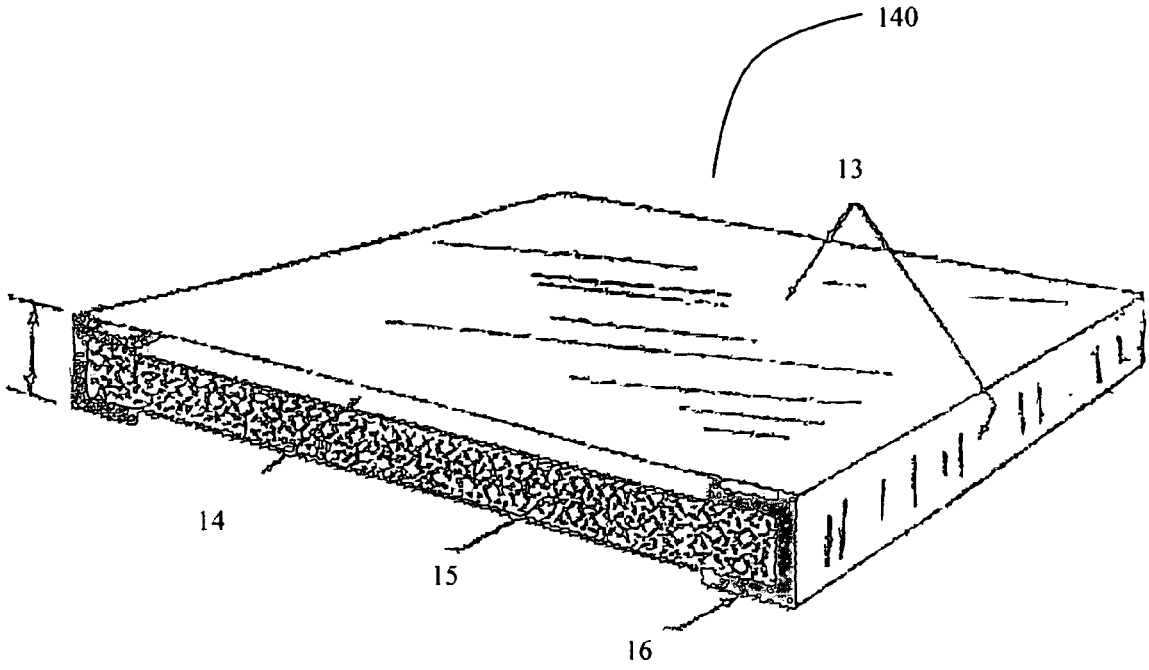
FIG. 5. shows a shatter proof mirror.

A shatter proof mirror 140 is described in FIG. 5. The shatter proof mirror 140 includes an outer film 13. The film 13 may be for example, a polyester film. The film 13 is disposed above a rigid core 15. The rigid core 15 may be an aluminum foil-faced isocyanurate. An air space 14 is maintained between the film 13 and rigid core 15. The air space 14 maybe ¼ to ⅛ inch. The shatter proof mirror 140 includes a frame 16. The frame 16 may be aluminum extrusion nonflammable.

Figure 6:
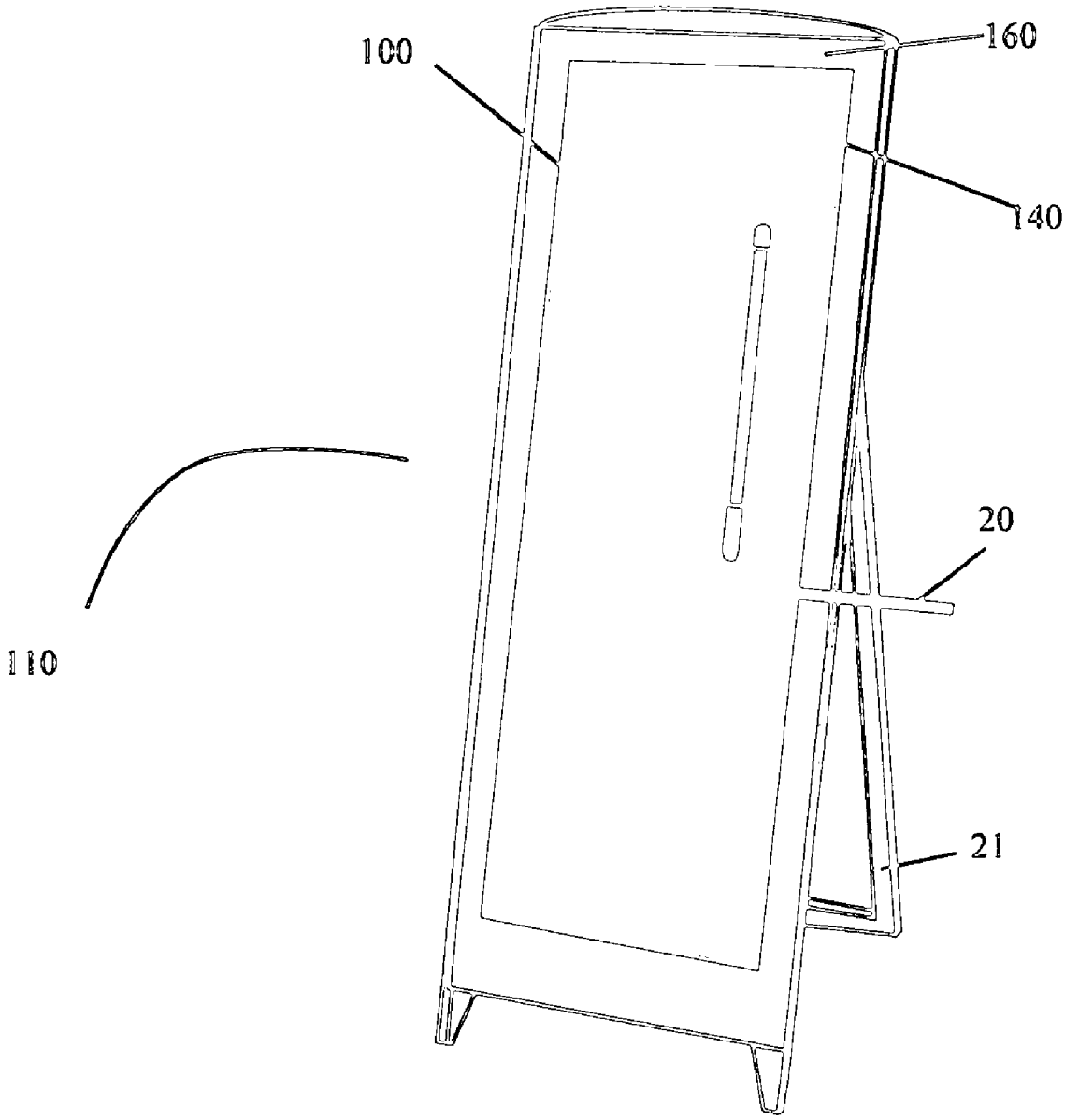
FIG. 6. provides an overview of the Straight Shot device.

As shown in FIG. 6, the mirror device 110 includes a frame 160 that contains a shatter proof mirror 140. A chaser bulb 100 is disposed within shatter proof mirror 140. An adaptor cord 20 extends away from the chaser bulb 100. The mirror device 110 may also include a frame stand 21 which is effective for support.

Figure 7:
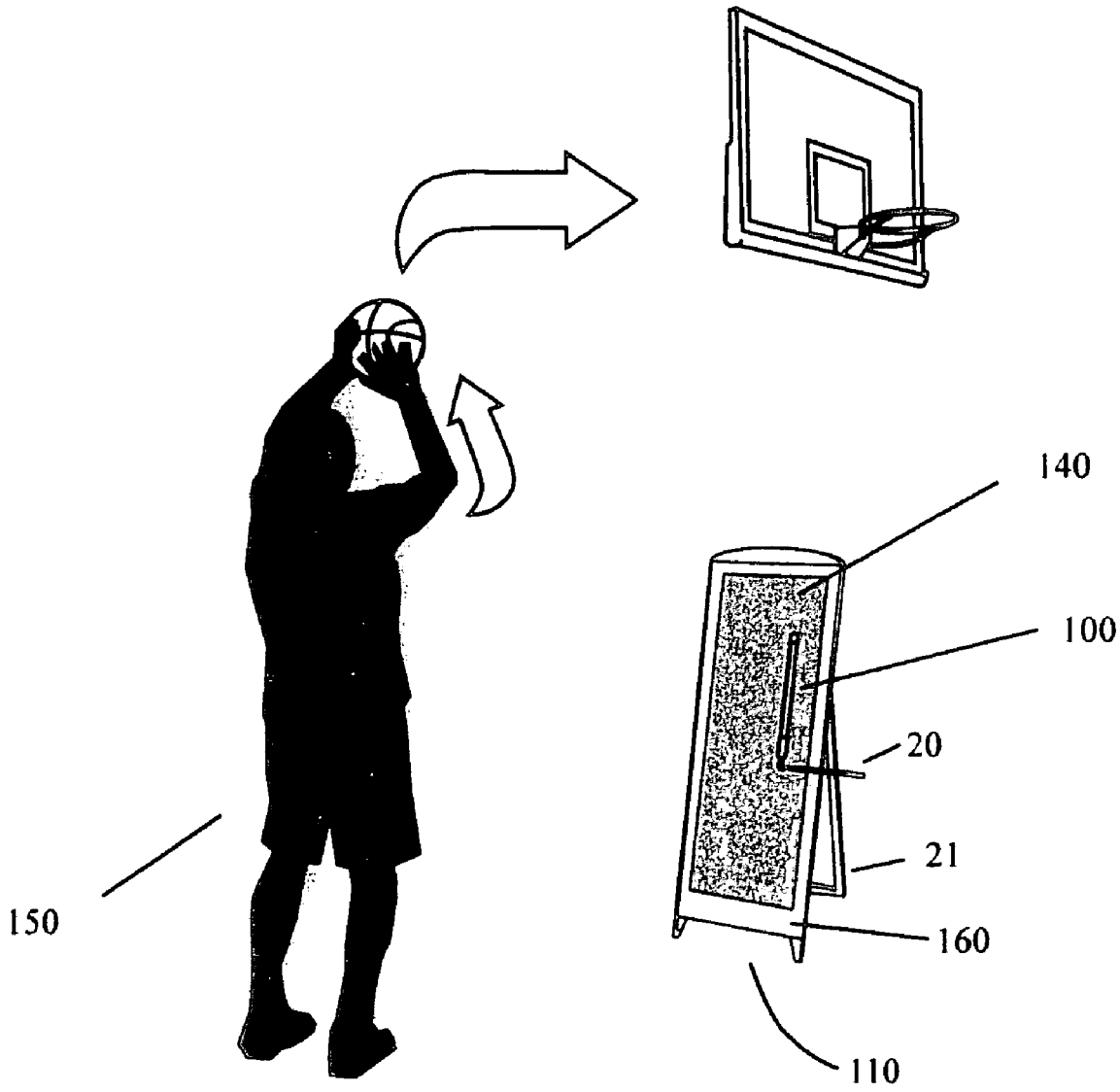
FIG. 7. shows an overview of the Straight Shot device with player and target background.

As shown in FIG. 7, the mirror 140 allows a shooter 150 to see a visual image of himself. The chase bulb 100 interrupts the image of the shooter in the shatter proof mirror 140 allowing the shooter 150 to position his arm correctly and follows the chaser bulb 100.

What I claim is:

1. A method for improving a basketball players' shooting skills, the method comprising:

providing a device, said device including a free-standing mirror; said free-standing mirror comprising: a front surface, a rear surface, a pair of vertical sides and a pair of horizontal sides; said rear surface further including a support stand for maintaining said free-standing mirror in an upright position on a playing surface;

providing an elongate bulb; said elongate bulb generating pulsating lights in an upward and downward direction;

providing a target;

positioning said free-standing mirror on said playing surface at a given distance between said player and said target such that said player is able to have simultaneous visual contact with said target and said free-standing mirror;

positioning said elongate bulb parallel to said pair of vertical sides of said free-standing mirror;

visually aligning said player's shooting arm with said pulsating lights generated by said elongate bulb, this allows for simultaneous self-correction of player's shooting arm; and following a vertical movement of said pulsating light to said target in a straight motion as a basketball is released, wherein repeated use of said device enables said player to achieve a correct arc and trajectory when releasing a basketball.

2. The method for improving a basketball player's shooting skills of claim 1, wherein said free-standing mirror is substantially rectangular shaped.

3. The method for improving a basketball player's shooting skills of claim 1, wherein said elongate bulb is a chaser bulb.

4. The method for improving a basketball player's shooting skills of claim 1, wherein said elongate bulb includes LED lights.

5. The method for improving a basketball player's shooting skills of claim 1, wherein said target comprising a basketball rim.

* * * * *